US007188509B1

(12) United States Patent
Goldstein

(10) Patent No.: US 7,188,509 B1
(45) Date of Patent: Mar. 13, 2007

(54) TOOL AND METHOD FOR ADJUSTING A DOOR HINGE

(76) Inventor: Steven M. Goldstein, 3404 Collins Ct., Fremont, CA (US) 94536

( * ) Notice: Subject to any disclaimer, the term of this patent is extended or adjusted under 35 U.S.C. 154(b) by 0 days.

(21) Appl. No.: 10/886,353

(22) Filed: Jul. 6, 2004

(51) Int. Cl.
*B21D 7/022* (2006.01)
*B21D 19/00* (2006.01)
*B21J 13/08* (2006.01)

(52) U.S. Cl. ..... 72/457; 72/458; 72/479; 81/165

(58) Field of Classification Search ..... 72/457, 72/458, 479; 81/165; 29/267
See application file for complete search history.

(56) References Cited

U.S. PATENT DOCUMENTS 1,078,829 A * 11/1913 Carpenter ..... 72/479
3,965,720 A 6/1976 Goodwin et al. ..... 72/458
4,034,595 A * 7/1977 Smith ..... 72/458
4,619,132 A 10/1986 McBee ..... 72/458
4,641,516 A 2/1987 Satoh ..... 72/48
5,365,649 A * 11/1994 Carl et al. ..... 29/267
5,435,030 A * 7/1995 Phillips ..... 7/138
5,875,535 A * 3/1999 Canoy ..... 29/275
6,257,101 B1 * 7/2001 Marlette et al. ..... 81/165
6,450,003 B1 * 9/2002 Pawson ..... 72/457
6,725,703 B1 * 4/2004 Johnson ..... 72/458
6,769,284 B1 * 8/2004 Dennis ..... 72/457

* cited by examiner

*Primary Examiner*—David B. Jones
(74) *Attorney, Agent, or Firm*—Robert Samuel Smith

(57) ABSTRACT

A tool for aligning a door hinge with the edge of the door to which it is mounted comprising a bar having a wrench on each end of the bar. The faces of each jaw of the respective wench are contoured to fit around a single knuckle of the hinge. The bar has a slit arranged to permit the jaws to open or close around the surface of a knuckle of the door hinge. A screw through the bar is arranged to permit tightening the jaws onto the knuckle when it is required to apply force to the hinge or loosen the tool when it is required to slip the tool off the hinge.

2 Claims, 3 Drawing Sheets

FIG. 5

1.PROVIDE TOOL BEING BAR WITH WRENCH AND TIGHTENING SCREWS ON END

2. TURN SCREWS TO SEPARATE JAWS AND SLIDE WRENCH ONTO KNUCKLES

3. TIGHTEN SCREW TO CLAMP ONTO HINGE KNUCKLES

4 APPLY FORCE ON BAR TO ALIGN HINGE PLAE WITH DOOR EDGE.

5 TURN SCREW TO LOOSEN WRENCH

6 SLIDE WRENCH OFF HINGE

TOOL AND METHOD FOR ADJUSTING A DOOR HINGE

The typical door hinge, shown in FIG. 1, includes two hinge plates, 14, 18, and a hinge pin 20. Each hinge plate 14, 18, has one or more knuckles 16 that are aligned with the one or more knuckles 16 of the other hinge plate. The hinge pin through the knuckles secures the hinge plates 11 together.

Most metal doors and door frames have hinges attached to a mounting plate which is secured to the door frame.

A cross section of the assembled hinge 11 is shown in FIG. 2. A bend 21 in each hinge plate (called a swage) is formed in order that, when the door is closed, the door will close properly.

However, as the door ages, and even oftentimes with new doors, the door will not close properly. There are several different causes for improper closure and each cause generally arises from one of several ways that a door hinge can be bent away from its intended shape.

A number of devices have been disclosed related to the mounting of doors on door frames and straightening hinges.

U.S. Pat. No. 3,965,720 to Goodwinn et al discloses a bar with bent end sections and a slot in each section facing opposite directions.

U.S. Pat. No. 4,619,132 discloses a tool with a head member that engages a portion of the hinge.

U.S. Pat. No. 4,641,516 to Masao discloses an arcuate punch and a plurality of detachable punches mountable on the fixed punch for changing the shape of the fixed punch.

U.S. Pat. No. 5,365,649 to Carl discloses a tool for seating a vehicular door hinge comprising a bifurcated head portion with a hand lever.

U.S. Pat. No. 5,435,030 to Phillips discloses a tool including a punch mounted orthogonally near one handle that is used initially to dislodge the pin from the knuckle. The other end has a wrench like spanner configuration that is engaged with the hinge. Force is applied to the handle to straighten bends in the hinge. The magnitude of force applied by the carpenter directly against the tool to bend the hinge is a matter of the carpenter's judgement. The carpenter's judgement is often time not accurate and results in misalignment.

U.S. Pat. No. 5,875,535 to Cannoy discloses a hinge pin removal tool comprising an elongated handle with an extension having a wedge shaped tip and pin for loosening the pin and driving the loosened pin from the knuckles of the hinge.

None of these problems can be conveniently corrected by the type of misalignment that is best described with reference to FIG. 4. FIG. 4 shows a hinge with two hinge plates 14, 18. Hinge plate 14 has knuckles 16A. Hinge plate 18 has knuckles 16B. When the hinge plates 14, 18 are mounted so that the centerline of knuckles 16A is not parallel to the edge 19 of frame 22 and the centerline of knuckles 16B is not parallel to the edge 21 of door 24, then, as illustrated in FIG. 4 there will be an uneven gap, G, between the edge of the door 24 and the door frame 22. A small misalignment of the top hinges can result in a large gap at the "floor-end" of the door.

SUMMARY OF THE INVENTION

An object of this invention is to provide a tool that can be securely engaged with a knuckle of a hinge secured onto a hanging door permitting a user to bend the hinge into alignment with the edges of the door and sill. It is intended that the tool engage the knuckle in a close fit in order that the tool may not slip when the user applies force to the tool engaged with the knuckle.

This invention is directed toward a bar having a rectangular cross section on each of whose ends is an adjustable wrench. Each wrench has a pair of jaws, one jaw facing another jaw. The jaw faces of the wrenches are contoured to slide over a hinge knuckle. Adjustment of the sliding fit of the wrench over the knuckle is provided by a slit formed in each end of the bar that bifurcate the ends of the bar. Each slit extends from the respective wrench to almost the center of the bar. One screw for each wrench is threaded into the respective end of the bar, adjacent the wrench. The screws are tightened to clamp the jaws of each wrench tightly onto the respective knuckle. Once the wrench is clamped onto the knuckle, the wrench will not slip when force is applied to bend the knuckle.

BRIEF DESCRIPTION OF THE DRAWINGS

FIG. 5 is a flow chart of the method for straightening the single knuckle.

DESCRIPTION OF A BEST MODE FOR CARRYING OUT THE INVENTION

Figure 1:
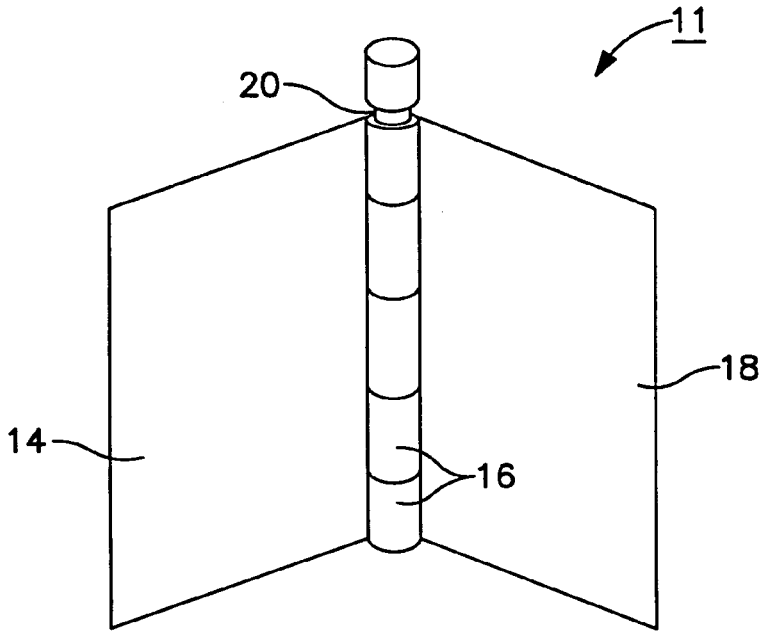
FIG. 1 is a perspective view of a hinge according to the prior art.
Figure 2:
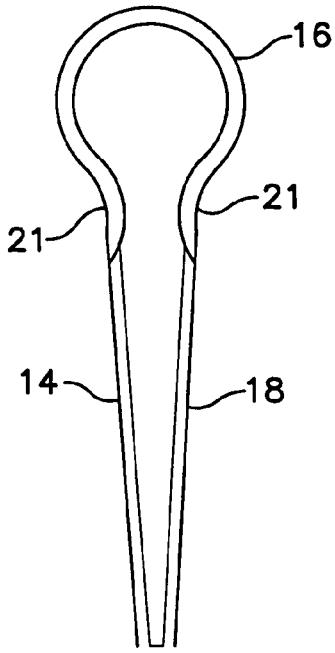
FIG. 2 is an end view of the hinge of FIG. 1.
Figure 3:
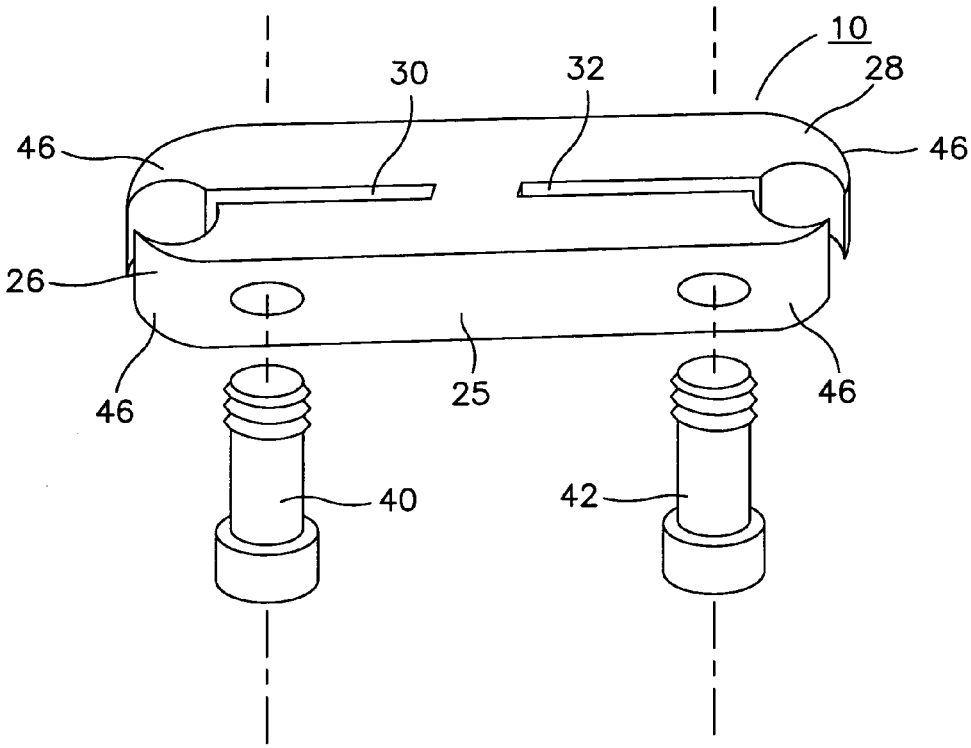
FIG. 3 is a perspective view of the tool of this invention.
Figure 4:
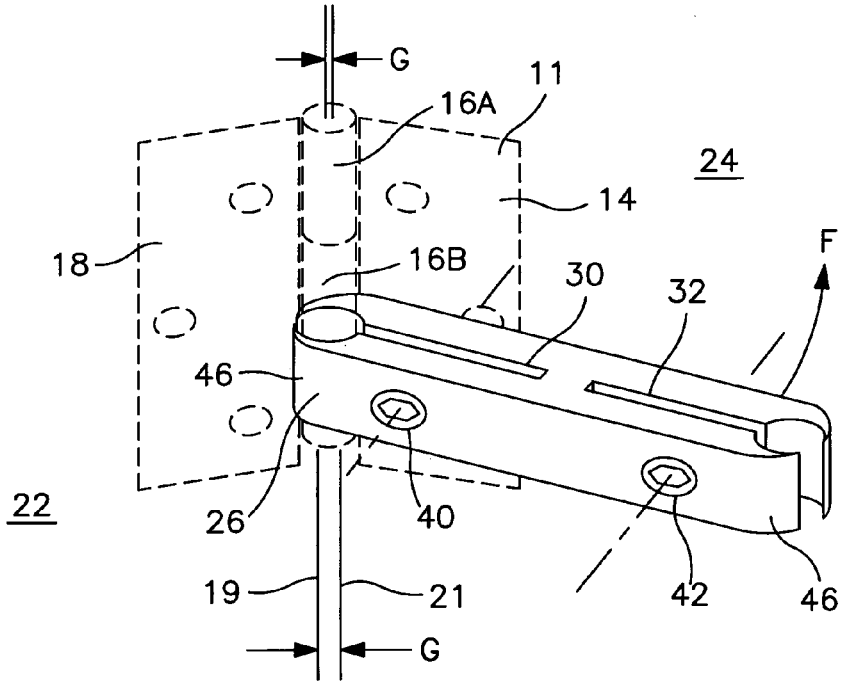
FIG. 4 shows the tool mounted on a knuckle.

Turning now to a discussion of the drawings, FIG. 3 shows a perspective view of the hinge tool 10 of this invention being a bar 25 having a rectangular cross section. Two wrenches 26, 28 are shown, one wrench 26 mounted on one end of the bar 25 and another wrench 28 on the opposite end of the bar 25. FIG. 4 shows one of the wrenches 26 engaging the knuckle 16B of the hinge 11. Hinge 11 is shown in phantom in FIG. 4. Each wrench 26, 28 is offset from the centerline of the bar 12 to facilitate aligning the knuckle with the wrench 26 clamped to the knuckle 16B. The jaws 46 of the wrench are contoured to slide onto and enclose the knuckle 16. A pair of slits, 30, 32 are shown in the bar 25. In each end of the bar, a slit, 30, 32 extends from between the jaws 46 of the wrench 26, 28 almost to the center of the bar 25. A screw 40, 42 through each slit 30, 32 respectively, is threaded into each end of the bar 24 that may be turned to draw the jaws 46 of each wrench, 26, 28 together so that the fit of the wren**6*h* 26, 28 onto the knuckle may be adjusted to clamp onto the knuckle 16B, fit snugly onto the knuckle 16B or be loosely engaged on the knuckle 16*b*. Once the wench 26 is firmly engaged on the knuckle 16B, then force F can be conveniently applied to straighten the hinge 11 relative to the door 20 or jamb 22**.

FIG. 5 is a flow chart illustrating the method for using the tool of this invention.

In step 1, providing a tool being:

a bar with a rectangular cross section;

a wrench on at least one end of the bar;

the wrench having a jaw with an arcuate face facing an arcuate face of an opposite jaw of the wrench contoured to enclose said single knuckle;

a slit extending from between the jaw and opposite jaw toward a center of the jaw;

a screw the bar and traversing the slit and operably arranged to adjust a fit of the jaw and opposite jaw around said the knuckle;

In step 2, turning the screw in a direction to separate one jaw from an opposite jaw to where the jaws are sufficiently separated to slide over knuckles of the hinge to where it encloses the single knuckle;

In step 3. turning the screw in a direction to tighten jaws of the wrench onto the single knuckle;

In step 4, applying sufficient force on the bar in a direction to straighten align the hinge plate with the edge of the door;

In step 5, turning the screw in a direction to loosen the wrench from the single knuckle;

In step 6, sliding the tool away from the single knuckle and disengage the tool from the door hinge.

An important advantage of the wrench construction is that a very substantial clamping force may be applied by the jaws of the wrench onto a single knuckle seated in the wrench. This provides a very secure grip of the bar onto the hinge permitting the user to apply the force required to force the hinge into alignment with the door edge.

Another advantage is the enveloping closure of the arcuate jaws on the knuckle mitigates against disfiguring the knuckle during the straightening operation.

Variations and modifications of this invention may be contemplated after reading the specification and studying the drawings which are within the scope of the invention. I therefore wish to define the scope of my invention by the appended claims.

What is claimed is:

1. A tool for grasping a single knuckle of a door hinge mounted onto a door in order to force and align the door hinge relative to an edge of the door hinge, said tool comprising:

a bar;

said bar having a substantially cylindrical opening near one end of said bar with a centerline of said cylindrical opening being perpendicular to a long dimension of said bar and extending between opposite flat surfaces of said bar;

said bar having a slit extending from said one end of said bar to said cylindrical opening and from said cylindrical opening to near a center of said bar wherein walls of said slit are parallel to a centerline of said opening;

said slit separating said bar into one jaw opposite an opposite jaw;

said cylindrical opening having a diameter selected to permit slidably positioning said knuckle within said cylindrical opening;

a screw hole extending through said one jaw and said opposite jaw where a part of said screw hole within said said one jaw is threaded;

a screw positionned through said screw hole and screwed into said threaded part of said screwhole providing that when said jaws are squeezed together by turning said screw, said jaws are clamped onto said knuckle when said knuckle is positioned in said cylindrical opening.

2. A method for aligning a door hinge with an edge of a door to which said door hinge is attached which includes the steps in operable order (a) providing a tool, said tool comprising:

a bar;

said bar having a substantially cylindrical opening near one end of said bar with a centerline of said cylindrical opening being perpendicular to a long dimension of said bar and extending between opposite flat surfaces of said bar, said bar having a slit extending from said one end of said bar to said cylindrical opening and from said cylindrical opening to near a center of said bar wherein walls of said slit are parallel to a centerline of said opening;

said slit separating said bar into one jaw opposite an opposite jaw;

said cylindrical opening having a diameter selected to permit slidably positioning said knuckle within said cylindrical opening;

a screw hole extending through said one jaw and said opposite jaw where a part of said screw hole within said one jaw is threaded;

a screw positionned through said screw hole and screwed into said threaded part of said screwhole providing that when said jaws are squeezed together by turning said screw, said jaws are clamped onto said knuckle when said knuckle is positioned in said cylindrical opening;

(b) turning said screw in a direction to separate one jaw from an opposite jaw to where said wrench is open sufficiently to slide over knuckles of said hinge to where it encloses said single knuckle;

(c) turning said screw in a direction to tighten said wrench onto said single knuckle;

(d) applying sufficient force on said bar in a direction to align said hinge with an edge of said door;

(e) turning said screw in a direction to loosen said wrench from said single knuckle;

(f) sliding said tool away from said single knuckle and disengage said tool from said door hinge.

* * * * *